US006354100B1

(12) United States Patent
Spanos et al.

(10) Patent No.: US 6,354,100 B1
(45) Date of Patent: Mar. 12, 2002

(54) AIR CONDITIONER CHARGE VALVE

(75) Inventors: Gary P. Spanos, Lynchburg; Major H. Gilbert, Gladys, both of VA (US)

(73) Assignee: Schrader Bridgeport International, Inc., Buffalo Grove, IL (US)

( * ) Notice: Subject to any disclaimer, the term of this patent is extended or adjusted under 35 U.S.C. 154(b) by 0 days.

(21) Appl. No.: 09/761,028

(22) Filed: Jan. 16, 2001

(51) Int. Cl.[7] ..... F25B 45/00; F16K 25/00
(52) U.S. Cl. ..... 62/292; 62/77; 137/454.2
(58) Field of Search ..... 62/77, 292; 137/234.5, 137/454.2

(56) References Cited

U.S. PATENT DOCUMENTS

| | | | | |
|---|---|---|---|---|
| 3,299,648 A | | 1/1967 | White et al. | |
| 3,976,110 A | | 8/1976 | White | |
| 4,383,548 A | * | 5/1983 | Durenec et al. | 137/321 |
| 4,535,802 A | * | 8/1985 | Robertson | 137/322 |
| 4,753,267 A | | 6/1988 | Starr et al. | |
| 5,396,774 A | | 3/1995 | Hubbell, Jr. | |
| 5,653,256 A | | 8/1997 | Myers et al. | |
| 5,758,506 A | | 6/1998 | Hancock et al. | |
| 5,957,147 A | | 9/1999 | Hubbell, Jr. | |
| 6,003,905 A | * | 12/1999 | Moffa et al. | 285/133.11 |
| 6,266,971 B1 | * | 7/2001 | Schroder et al. | 62/292 |
| 6,273,397 B1 | * | 8/2001 | Schultz et al. | 251/149.6 |

OTHER PUBLICATIONS

The Lee Company, product data sheet, "Short Betaplug (Seal–For–Life)", 3 pages, 1995.
U.S. application No. 09/472,260, filed Dec. 27, 1999, pending.

* cited by examiner

*Primary Examiner*—William C. Doerrler
(74) *Attorney, Agent, or Firm*—Brinks Hofer Gilson & Lione

(57) ABSTRACT

An air conditioning charging valve includes a valve body that receives a valve element in an interference fit. The valve element is slideable by a charging tool from an opened positioned, in which a refrigerant fluid may be charged into an air conditioning system via the charge valve, and a closed position, in which the valve element forms a leak free, metal-to-metal seal against a valve seat carried by the valve body.

13 Claims, 4 Drawing Sheets

Fig 2
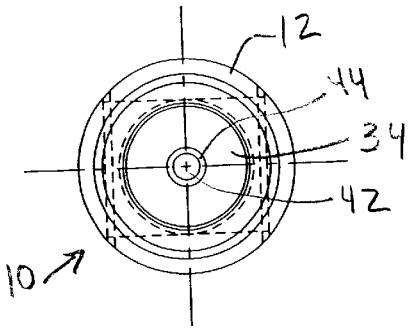
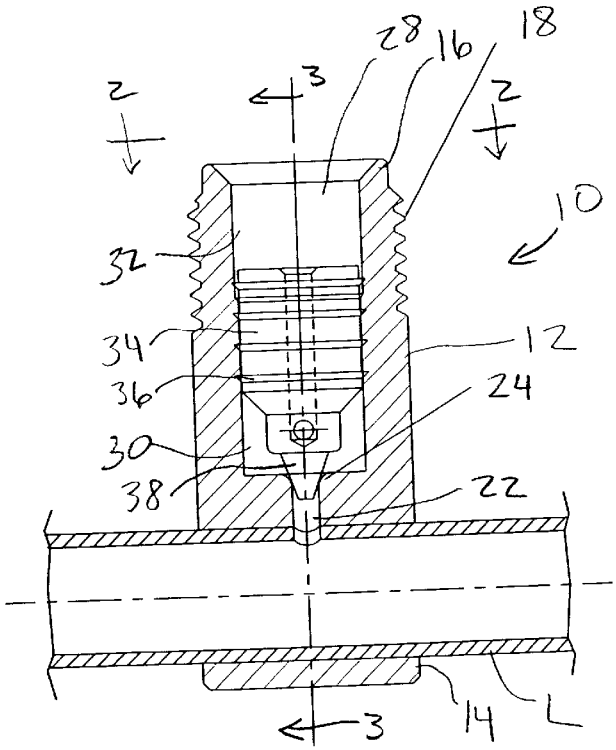
Fig 1
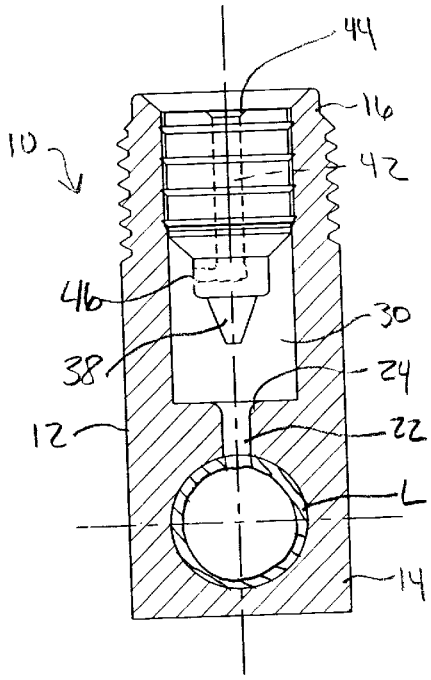
Fig 3

Fig 5
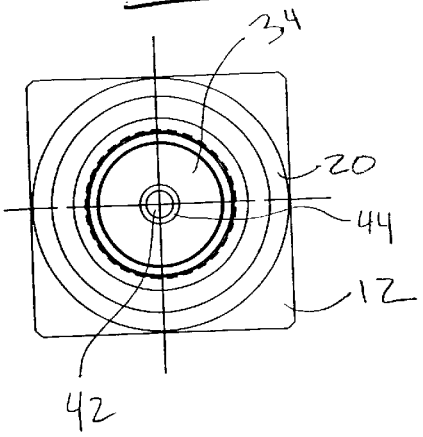
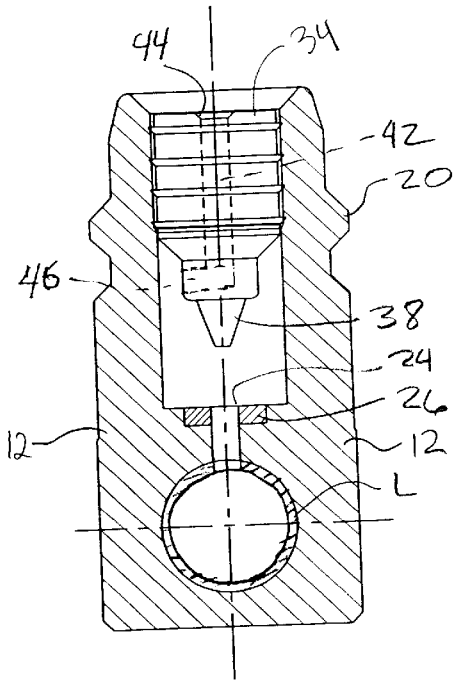
Fig 6
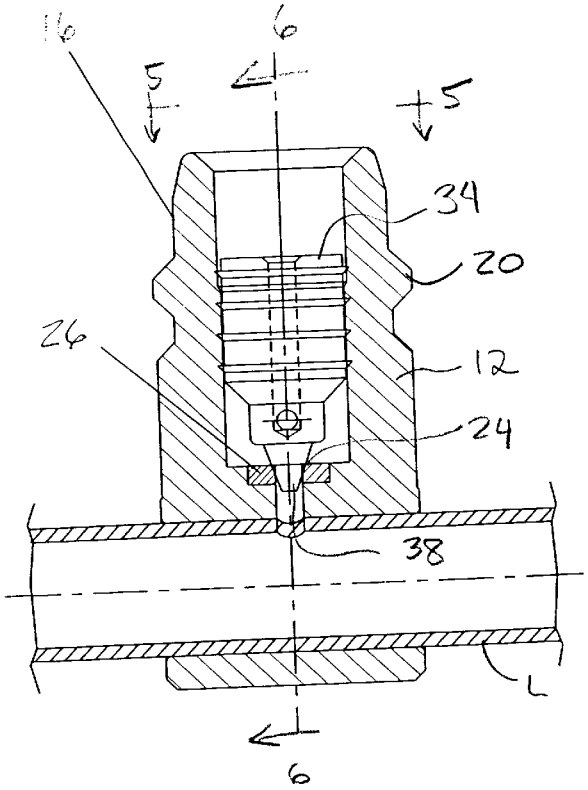
Fig 4

28
86
82
90
88
84

10
34
42
38
26
48
20
16
28
L 34
48
40
42
24
L

AIR CONDITIONER CHARGE VALVE

BACKGROUND

This invention relates to charge valves for air conditioning systems, and in particular to charge valves that provide extremely low leakage rates.

Air conditioner systems typically include a charge valve positioned on an air conditioner line of the system. A refrigerant fluid is introduced into the system via the charge valve. In the past, charge valves have typically included a valve core that is threaded in place in a valve body. The valve core is depressed or removed for charging operations, and once installed the valve core relies on an elastomeric seal to close the charging passageway. See for example the arrangement disclosed in White U.S. Pat. No. 3,299,648.

U.S. patent application Ser. No. 09/472,260, assigned to the assignee of the present invention, discloses another charge valve that uses a twist-to-open valve that forms a metal to metal seal when closed. This twist-to-open valve is threadedly engaged with the valve body, and rotation of the valve moves it axially with respect to the valve body.

A need presently exists for an improved charge valve that is low in cost, that is simple to operate, and that provides a leak-free seal when closed.

BRIEF SUMMARY

By way of introduction, the charge valves described below include a valve body that defines a bore that is in fluid communication with an air conditioner line via a valve seat. A slide-to-seal valve element is positioned in the bore in an interference fit with the valve body. This valve element is shaped to open the valve at the valve seat when in an opened position and to seal the valve at the valve seat when in a closed position. The interference fit retains the valve element in the closed position without any threaded connection between the valve element and the valve body. A charging passage having an inlet on one side of the valve element and an outlet on the other side of the valve element is positioned to conduct charging fluid across the valve element and through the valve seat when the valve element is in the opened position. Once the air conditioning system has been charged, the valve element is rammed to the closed position, without any substantial rotation, and the interference fit described above maintains the valve element in the closed position.

This section has been provided by way of general introduction, and it is not intended to narrow the scope of the following claims.

BRIEF DESCRIPTION OF THE DRAWINGS

FIG. 1 is a cross-sectional view of a charge valve that incorporates a first embodiment of this invention, showing the valve element in a closed position.

FIG. 2 is a top view taken along line 2—2 of FIG. 1.

FIG. 3 is a cross-sectional view taken along line 3—3 of FIG. 1, showing the valve element in an opened position.

FIG. 4 is a cross-sectional view of a charge valve that incorporates a second preferred embodiment of this invention, showing the valve element in a closed position.

FIG. 5 is a top view taken along line 5—5 of FIG. 4.

FIG. 6 is a cross-sectional view taken along line 6—6 of FIG. 4, showing the valve element in the opened position.

DETAILED DESCRIPTION OF THE PRESENTLY PREFERRED EMBODIMENTS

Figures 7, 8:
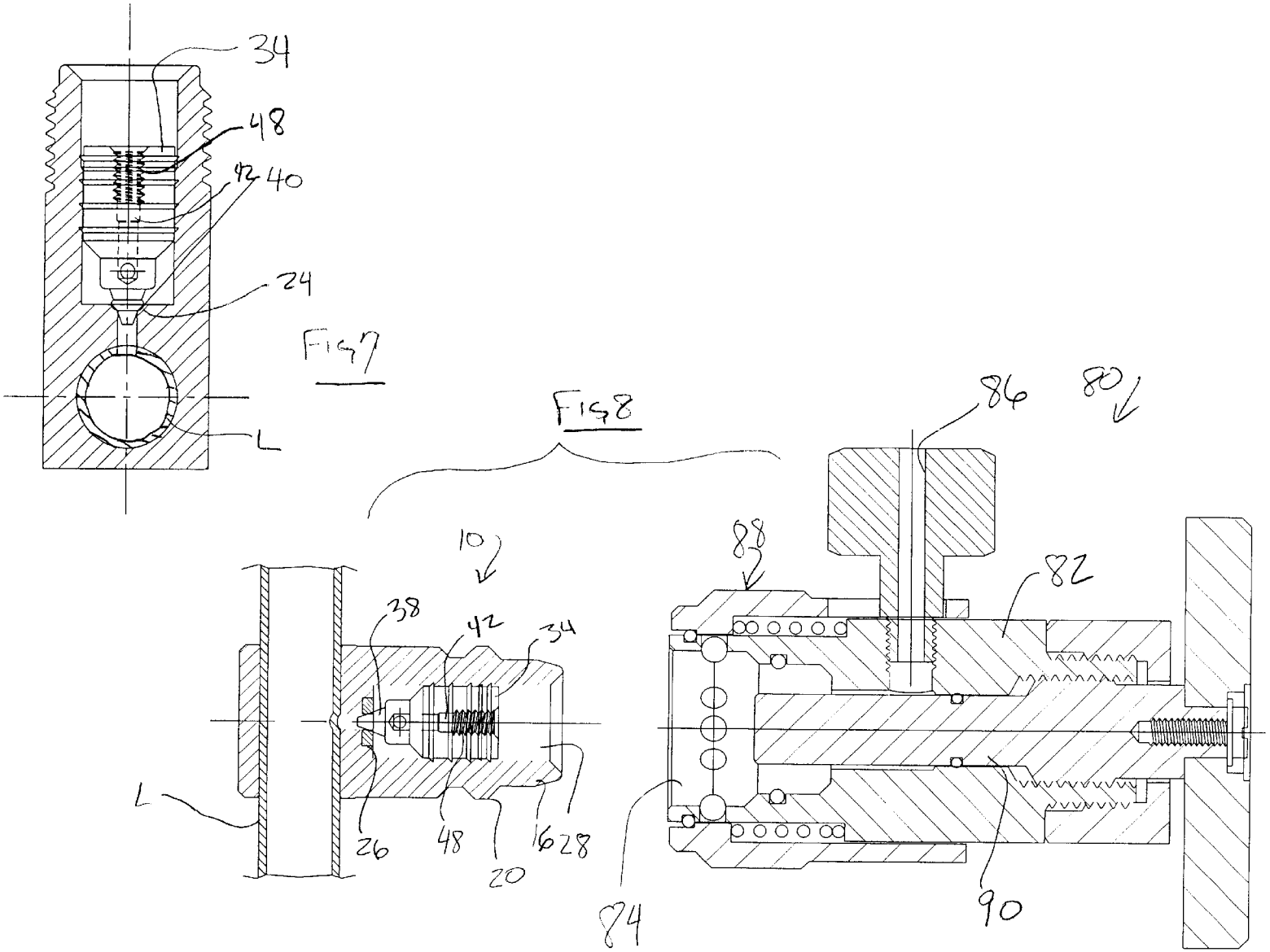
FIG. 7 is a cross-sectional view of a third charge valve, taken in the plane of FIGS. 3 and 6.
FIG. 8 is an exploded sectional view showing a fourth charge valve in relation to a charging tool.

Turning now to the drawings, FIG. 1 shows a cross-sectional view of a charge valve 10 that includes a valve body 12 having a connection portion 14 and a second portion 16. The connection portion 14 is attached to a line L of an air conditioning system, such as an automotive air conditioning system for example. In this example, the connection portion 14 defines an opening sized to receive the line L. In alternative embodiments, the connection portion 14 can include a neck that is secured in place (as for example by brazing) to an aperture formed in the line L. Other techniques can be used for connecting the valve body 12 to the line L.

The second portion 16 of the valve body 12 defines on an exterior surface a set of external threads 18. These threads 18 are used to secure a charging tool (not shown in FIG. 1) to the valve body 12.

The valve body 12 defines a port 22 that is in fluid communication with the interior of the line L via an opening in the line L. This port 22 is surrounded by an annular valve seat 24, and the annular valve seat 24 is positioned at the transition between the port 22 and a bore 28. In this example, the bore 28 is smooth walled and circular in cross section, though other arrangements are possible. For example, the bore 28 may have a non-circular cross section (e.g. triangular, square, hexagonal or oblong), or the bore 28 may define an array of ridges or other protruding elements. In this example the bore 28 defines a smaller portion 30 and a larger portion 32. The smaller portion 30 is positioned between the larger portion 32 and the valve seat 24. By way of example, the larger portion 32 may have an internal diameter that is 0.45 millimeters greater than the internal diameter of the smaller portion 30.

As shown in FIG. 1, the charge valve 10 includes a slide-to-seal valve element. This slide-to-seal valve element 34 defines an array of external annular ridges 36 and a pin 38. The pin 38 is positioned to form a metal-to-metal seal with the valve seat 24. In the example of FIG. 1, the pin 38 is a brass tapered pin, and the valve seat 24 is formed of steel. When the slide-to-seal valve element 34 is positioned in the closed position of FIG. 1, the pin 38 forms a leak-free, metal-to-metal seal against the valve seat 24. The valve element 34 fits within the bore 28 in an interference fit. This interference fit is tighter in the smaller portion 30 than the larger portion 32, and when the valve element 34 is in the closed position of FIG. 1, this interference fit prevents the pin 38 from backing away from the valve seat 24 and preserves the desired leak-free seal. By way of example, the valve element 34 may have an outer diameter of 9.90 millimeters and the smaller portion 30 may have a diameter of 9.10 millimeters.

As shown in FIG. 3, the valve element 34 includes a charging passage 42 having an inlet 44 on one side of the valve element 34 and an outlet 46 on the other side of the valve element 34. FIG. 3 shows the valve element 34 in an opened position, in which the pin 38 is spaced away from the valve seat 24, and the port 22 is in fluid communication with the charging passage 42. The larger portion 32 of the bore 28 is sized to receive the valve element 34 in a relatively loose interference fit that holds the valve element 34 in place, yet can be easily assembled. The smaller portion 30 of the bore 28 holds the valve element 34 in the closed position of FIG. 1 in a much tighter interference fit.

Many alternatives are possible. For example, the charge valve of FIGS. 4 through 6 is similar to the charge valve of FIGS. 1 through 3, except that the external threads of FIG. 1 are replaced with an annular ridge 20 adapted for connection with a conventional quick-release coupler. Also, in the embodiment of FIGS. 4 through 6 the valve seat 24 is formed as a separate element 26 that is separately formed and then secured in place to the valve body 12. For example, the pin 38 of FIGS. 4 and 6 can be formed of a material such as brass, and the separate element 26 that defines the valve seat 24 maybe formed of a soft metal such as copper.

FIG. 7 shows a cross-sectional view of a third charge valve that incorporates a preferred embodiment of this invention. This charge valve is quite similar that described above in conjunction with FIGS. 1 through 3, except that the pin comprises an annular ridge that functions as a crush ring 40. In this example, the pin and the crush ring 40 may be formed of brass, and the valve seat 24 may be formed of steel.

Also, the valve of FIG. 7 includes an array of threads 48 adapted to releasably engage an extraction tool (not shown in FIG. 7). Such a tool can be threaded into the valve element 34 and then pulled to move the valve element 34 upwardly in the view of FIG. 7, away from the valve seat 24. In this way, the valve of FIG. 7 can be opened for service procedures. In the example of FIG. 7, the array of threads 40 is formed as an array of internal threads around the charging passage 42. Alternatively, the array of threads may be formed as external threads on a protruding portion of the valve element 34 (not shown in FIG. 7).

Many other arrangements are possible for the valve seat and the pin. For example, the pin may be a steel pin cooperating with a steel valve seat. The important point is that the valve element form a leak-free, metal-to-metal seal against the valve seat, and that the valve element be held in the closed position by an interference fit when the valve element is press fit into the bore in the closed position.

FIG. 8 shows a fourth valve in association with a charging tool 80. The fourth valve is similar to the valve of FIG. 4, except that the charging passage 42 defines an array of internal threads 48, similar to the threads 48 discussed above in conjunction with FIG. 7.

The charging tool 80 includes a tool body 82 that defines an internal cavity 84 shaped to receive the second portion 16 of the charge valve. The charging tool 80 includes a channel 86 adapted for connection to a source of refrigerant fluid (not shown). This channel 86 conducts refrigerant fluid through the tool body 82 into the cavity 84. In use, a shut off valve (not shown) is provided to allow a user to control the flow of refrigerant fluid through the channel 86.

The charging tool 80 also includes an attachment mechanism 88 for releasably attaching the charging tool 80 to the charge valve. In this example the attachment mechanism 88 takes the form of a conventional quick-release mechanism designed to engage the annular ridge 20 when the second portion 16 is moved into the cavity 84. The attachment mechanism 88 can be released in the conventional manner when it is desired to disengage the charging tool 80 from the charge valve. The attachment mechanism can take many forms, depending upon the configuration of the charge valve. For example, when the charge valve has external threads 18 as described above in conjunction with FIG. 1, the attachment mechanism takes the form of mating internal threads adapted to threadedly engage the external threads 18 of the charge valve. Other arrangements are possible.

The charging tool 80 also includes a ram 90 that is used to move the valve element 34 from the opened position to the closed position described above. In this example, the ram 90 takes the form of a partially threaded shaft that is engaged with the valve body 82. Manual rotation of this shaft in a clockwise direction causes the ram 90 to move to the left as shown in FIG. 8, thereby forcing the valve element 34 to the left in the valve body.

Figure 9:
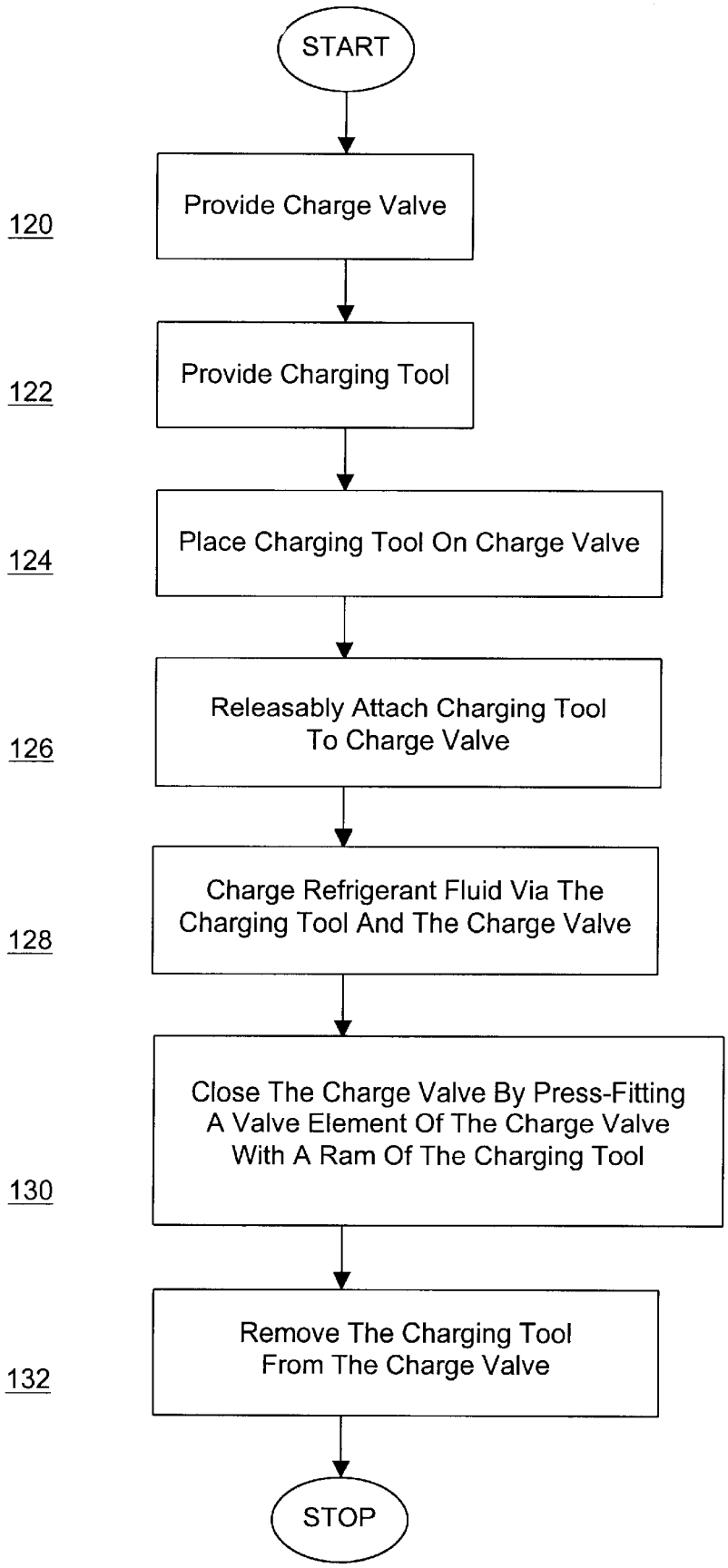
FIG. 9 is a flowchart of a method using the elements of FIG. 8.

The charging tool 80 of FIG. 8 is used to charge an air conditioning system with refrigerant fluid using any of the charge valves described above. As shown in FIG. 9, first a charge valve is provided in block 120. This charge valve can correspond to any of the charge valves of FIGS. 1 through 8. Next, in block 122 a charging tool is provided, as for example the tool 80 of FIG. 8. Then the charging tool is placed on the charge valve (block 124) and releasably attached to the charge valve (block 126). In block 128 refrigerant fluid is then charged into the air conditioner system via the charging tool and the charge valve. At this point in the method of FIG. 9, the valve element 34 is in the opened position shown in FIGS. 3 and 6, and refrigerant fluid passes via the charging passage, the valve seat and the port into the line L. Once the air conditioner system has been properly charged, the charge valve is closed by press fitting the valve element 34 with the ram 90 of the charging tool 80. This press fit operation is continued until the valve element 34 is moved to the closed position shown in FIGS. 1, 4, 7 and 8, in which the valve element forms a leak-free, metal-to-metal seal with the valve seat. Once the charge valve has been closed, the refrigerant fluid flow is stopped and the charging tool 80 is removed from the charge valve by properly manipulating the attachment mechanism 88.

It should be apparent from the foregoing that an improved charge valve and method have been described that allow high-speed charging of an air conditioning system and simple closing of the charge valve. Once the charge valve is closed, the metal-to-metal seal described above insures that the charge valve is substantially leak free. For this reason, this charge valve is well-suited for use with high-pressure refrigerant fluids such as carbon dioxide.

Of course, many alternatives are possible. For example, the valve element may be formed in one piece as described above, or alternately the valve element may be formed as an assembly of component parts, such as a separate body and pin. The charging passage described above may be formed in the valve body or the valve element. The ram described above may be operated using any suitable mechanism, including hydraulic, pneumatic, electrical and other systems. If desired, the valve element may be locked in place after it is press fit into the closed position by crimping or otherwise deforming the valve body to prevent the valve element from moving away from the closed position.

It is not essential in all embodiments that the valve element be received within the bore of the valve body at the beginning of the charging process. In alternative embodiments, the valve element may be positioned completely outside of the bore at the beginning of the charging process, and only press fit into the bore after the charging process has been completed. Of course, the bore does not have to define larger and smaller portions as described above, and the bore can be of uniform cross section throughout if desired.

As used here in the term "position" is intended broadly to encompass a range of positions. For example, the valve element is said to be in the opened position when it is in any of a range of positions in which the charging passage is in fluid communication with the port.

The foregoing detailed description has described only a few of the many forms that this invention can take. For this reason, this detailed description is intended by way of illustration, and not limitation. It is only the following claims, including all equivalents, that are intended to define the scope of this invention.

What is claimed is:

1. An air conditioner charge valve comprising:

a valve body comprising a connection portion shaped to engage an air conditioner line and a second portion comprising one of an external annular ridge and an external thread, said valve body further comprising a port in fluid communication with the connection portion, a valve seat surrounding the port, and a bore in fluid communication with the port;

a slide-to-seal valve element dimensioned to slide in the bore in an interference fit with the valve body, said valve element shaped to open the port at the valve seat when the valve is in an opened position and to seal the port at the valve seat when the valve element is in a closed position, said valve element and said connection portion positioned on opposite sides of the port, said interference fit operative to retain the valve element in the closed position without a threaded interconnection between the valve element and the valve body.

2. The invention of claim 1 wherein the bore comprises a smaller portion and a larger portion, said smaller portion positioned closer to the port than the larger portion, said smaller portion dimensioned to receive the valve element in a tighter interference fit than the larger portion.

3. The invention of claim 1 wherein the valve element comprises a pin configured to fit within and to seal against the valve seat.

4. The invention of claim 3 wherein the pin comprises a crush ring.

5. The invention of claim 1 wherein the valve seat is formed by an element that is separately formed from and secured to the valve body.

6. The invention of claim 1 wherein the valve seat is integrally formed with the valve body.

7. The invention of claim 1 wherein the valve element comprises an array of annular ridges, wherein the bore is smooth-walled, and wherein the ridges create the interference fit with the valve body.

8. The invention of claim 1 wherein one of the valve body and the valve element forms a charging passage having an inlet on a first side of the valve element and an outlet on a second side of the valve element, said charging passage in fluid communication with the port when the valve element is in the opened position.

9. The invention of claim 8 wherein the charging passage is formed in the valve element.

10. The invention of claim 1 wherein the valve element comprises a set of threads accessible from a point exterior to the valve body to releasably secure the valve element to a retraction tool.

11. The invention of claim 1 wherein the seat and the valve element form a metal-to-metal seal when the valve element is in the closed position.

12. The invention of claim 1 wherein the valve body and the valve element form a metal-to-metal interference fit therebetween.

13. A method of charging an air conditioner line, said method comprising:

(a) providing an air conditioner charge valve comprising:

a valve body comprising a connection portion shaped to engage an air conditioner line and a second portion comprising one of an external annular ridge and an external thread, said valve body further comprising a port in fluid communication with the connection portion, a valve seat surrounding the port, and a bore in fluid communication with the port;

a slide-to-seal valve element dimensioned to slide in the bore in an interference fit with the valve body, said valve element shaped to open the port at the valve seat when the valve is in an opened position and to seal the port at the valve seat when the valve element is in a closed position, said valve element and said connection portion positioned on opposite sides of the port, said interference fit operative to retain the valve element in the closed position without a threaded interconnection between the valve element and the valve body;

(b) providing a charging tool comprising:

a tool body forming a cavity to receive the charging valve, said tool body comprising a channel for conducting a refrigerant fluid into the cavity;

an attachment mechanism releasably attaching the tool body to the charging valve; and a ram for moving the valve element away from the tool body without rotating said valve element relative to the tool body;

(c) placing the tool body on the charge valve with the charge valve partially received in the cavity and the valve element in the opened position;

(d) releasably attaching the tool body to the charge valve with the attachment mechanism;

(e) charging a refrigerant fluid into the air conditioner line via the channel, the bore, and the port after (d);

(f) moving the valve element substantially without rotation to the closed position with the ram after (e), thereby press fitting the valve element in place in the closed position; and (g) removing the tool body from the charge valve after (f).

* * * * *